US008345077B2

(12) United States Patent
Hayashi

(10) Patent No.: US 8,345,077 B2
(45) Date of Patent: Jan. 1, 2013

(54) WRITE DEVICE, IMAGE FORMING APPARATUS, AND OPEN/CLOSE CONTROL METHOD

(75) Inventor: Shingo Hayashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 393 days.

(21) Appl. No.: 12/796,208

(22) Filed: Jun. 8, 2010

(65) Prior Publication Data

US 2010/0316395 A1 Dec. 16, 2010

(30) Foreign Application Priority Data

Jun. 12, 2009 (JP) ..... 2009-141175

(51) Int. Cl.
*B41J 15/14* (2006.01)
*B41J 27/00* (2006.01)

(52) U.S. Cl. ..... 347/241; 347/256

(58) Field of Classification Search ..... 347/230, 347/241, 242, 256, 257; 399/343, 345, 350, 399/357

See application file for complete search history.

(56) References Cited

U.S. PATENT DOCUMENTS 7,203,444 B2 * 4/2007 Yamazaki ..... 399/98
7,436,426 B2 * 10/2008 Lim ..... 347/263
7,872,664 B2 * 1/2011 Yamakawa et al. ..... 347/241
2010/0067061 A1 3/2010 Hayashi

FOREIGN PATENT DOCUMENTS

| | | |
|---|---|---|
| JP | 2-244171 | 9/1990 |
| JP | 6-214317 | 8/1994 |
| JP | 8-76656 | 3/1996 |
| JP | 2947872 | 7/1999 |
| JP | 2006-311036 | 11/2006 |
| JP | 2008-306366 | 12/2008 |
| JP | 2010-74288 | 4/2010 |

* cited by examiner

*Primary Examiner* — Hai C Pham
(74) *Attorney, Agent, or Firm* — Oblon, Spivak, McClelland, Maier & Neustadt, L.L.P.

(57) ABSTRACT

A write device includes an opening arranged on a casing of a write unit that emits irradiation light to expose a photoreceptor; a shutter unit movably mounted on the casing to open and close the opening; plural wall-like sections having respective different widths and being arranged in a standing manner on a side intersecting with a rotary shaft of a rotator that moves the shutter unit; a detecting unit that detects the plural wall-like sections moving in accordance with the rotation of the rotator; a measuring unit that measures a time period from when a wall-like section is detected until when the wall-like section is no longer detected; and a position detecting unit that determines the detected wall-like section by using the measured time period and the width thereof and detects the position of the shutter unit by using the determined wall-like section.

20 Claims, 11 Drawing Sheets

WRITE DEVICE, IMAGE FORMING APPARATUS, AND OPEN/CLOSE CONTROL METHOD

CROSS-REFERENCE TO RELATED APPLICATIONS

The present application claims priority to and incorporates by reference the entire contents of Japanese Patent Application No. 2009-141175 filed in Japan on Jun. 12, 2009.

BACKGROUND OF THE INVENTION

1. Field of the Invention

The present invention relates to a write device, an image forming apparatus, and an open/close control method.

2. Description of the Related Art

A printer that has an electrophotographic system includes a charge unit, a photoreceptor, a write device, a developing unit, a transfer unit, a fixing unit, a feed unit, and a discharge unit. In the printer, first, the charge unit charges the surface of the photoreceptor. Then, in the printer, the write device irradiates the surface of the photoreceptor with light so as to form an electrostatic latent image, the developing unit develops the latent image to form a developed image, the feed unit feeds a sheet, and the transfer unit transfers the developed image onto the sheet. Finally, in the printer, the fixing unit fixes the developed image to the sheet with applied heat and pressure, and then the discharge unit discharges the sheet to which the developed image is fixed.

The write device has a configuration such that it includes a window to allow the passage of laser light so as to irradiate the photoreceptor with the laser light through the window.

Because the window is a simple opening, the write device includes a dust preventing member to prevent foreign substances, such as paper dust or toner supplied from the developing unit at the developing stage after exposure, from getting inside the write device. The dust preventing member is a transparent optical element, inorganic glass, or the like, which allows the passage of laser light as well as prevents foreign substances from getting inside the write device.

There is a possibility that a user, or the like, spills toner and contaminates the dust preventing member during maintenance, such as when supplying toner or replacing consumables. The dust preventing member can be contaminated during normal use when a print process is being performed. Such contamination of the dust preventing member prevents appropriate exposure of the photoreceptor and, as a result, the desired image formation cannot be performed. Therefore, the user needs to clean the dust preventing member as appropriate.

For example, Japanese Patent Application Laid-open No. H02-244171 discloses an electrophotographic device in which a dust preventing member is mounted on a window, a shutter unit is arranged outside the window to open the window during normal use and close the window during maintenance, and a cleaning unit is attached to the shutter unit to clean the outer surface of the dust preventing member in accordance with the movement of the shutter unit.

In the electrophotographic device, during normal use, the shutter unit is open so that laser light is emitted through the window to irradiate the surface of the photoreceptor with the laser light. Meanwhile, during maintenance, the shutter unit is closed so as to cover the dust preventing member and close the window to cut off the laser light.

In a conventional write device, when the shutter unit is open during normal use or the shutter unit is closed during maintenance, the position of the shutter unit is determined by using one control plate 10 and a plurality of shutter sensors 20 and 21, as illustrated in FIG. 1.

Specifically, if a shutter unit 30 is in the open state, the control plate 10, which is arranged in series with the shutter unit 30, is detected by the shutter sensor 20. If the shutter unit 30 is moved in the direction indicated by the arrow Z and set in the closed state, the control plate 10 is detected by the shutter sensor 21. Thus, the position of the shutter unit 30 can be determined by using the shutter sensors 20 and 21.

However, if a plurality of shutter sensors is used in the write device, the structure is complicated and the manufacturing costs of the write device and the image forming apparatus on which the write device is mounted are increased; therefore, there is a problem in that the write device and the image forming apparatus on which the write device is mounted cannot be provided at a low cost.

Thus, there is a need for a write device and an image forming apparatus that can be provided at a low cost by decreasing the number of sensors so as to simplify the structure and reduce the cost.

SUMMARY OF THE INVENTION

It is an object of the present invention to at least partially solve the problems in the conventional technology.

According to an aspect of the present invention, there is provided a write device, the write device including an opening that is arranged on a casing that houses a light source that emits irradiation light to expose a photoreceptor, the opening allowing passage of the irradiation light, a shutter unit that is movably mounted on the casing and is moved to open and close the opening, a rotator that moves the shutter unit in accordance with rotation, a drive unit that rotates the rotator, a plurality of wall-like sections, each wall-like section having a different width and being arranged in a standing manner on a side intersecting with a rotary shaft of the rotator, a detecting unit that detects each of the wall-like sections that are moved in accordance with the rotation of the rotator, a measuring unit that measures a detection time period from when a wall-like section of the plurality of wall-like sections is detected until when the wall-like section is no longer detected, a position detecting unit that determines which one of the wall-like sections is the detected wall-like section by using the measured detection time period and the width of each of the wall-like sections and detects a position of the shutter unit on the casing by using the determined wall-like section, and an exposure control unit that controls exposure in accordance with the position of the shutter unit.

According to another aspect of the present invention, there is provided an image forming apparatus, the image forming apparatus including a photoreceptor, and a write unit that exposes the photoreceptor, wherein the write unit includes an opening that is arranged on a casing that houses a light source that emits irradiation light to expose the photoreceptor, the opening allowing passage of the irradiation light, a shutter unit that is movably mounted on the casing and is moved to open and close the opening, a rotator that moves the shutter unit in accordance with rotation, a drive unit that rotates the rotator, a plurality of wall-like sections, each wall-like section having a different width and being arranged in a standing manner on a side intersecting with a rotary shaft of the rotator, a detecting unit that detects each of the wall-like sections that are moved in accordance with the rotation of the rotator, a measuring unit that measures a detection time period from when a wall-like section of the plurality of wall-like sections is detected until when the wall-like section is no longer detected, a position detecting unit that determines which one of the wall-like sections is the detected wall-like section by using the measured detection time period and the width of each of the wall-like sections and detects a position of the shutter unit on the casing by using the determined wall-like section, and an exposure control unit that controls exposure in accordance with the position of the shutter unit.

According to another aspect of the present invention, there is provided an open/close control method performed by a write device, the write device including an opening that is arranged on a casing that houses a light source that emits irradiation light to expose a photoreceptor, the opening allowing passage of the irradiation light, a shutter unit that is movably mounted on the casing and is moved to open and close the opening, a rotator that moves the shutter unit in accordance with rotation, a drive unit that rotates the rotator, a plurality of wall-like sections, each wall-like section having a different width and being arranged in a standing manner on a side intersecting with a rotary shaft of the rotator, and a detecting unit that detects each of the wall-like sections that are moved in accordance with the rotation of the rotator, the open/close control method including measuring, by a measuring unit, a detection time period from when a wall-like section of the plurality of wall-like sections is detected until when the wall-like section is no longer detected, determining which one of the wall-like sections is the detected wall-like section by using the measured detection time period and the width of each of the wall-like sections, thereby detecting a position of the shutter unit on the casing by using the determined wall-like section, and controlling exposure in accordance with the position of the shutter unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
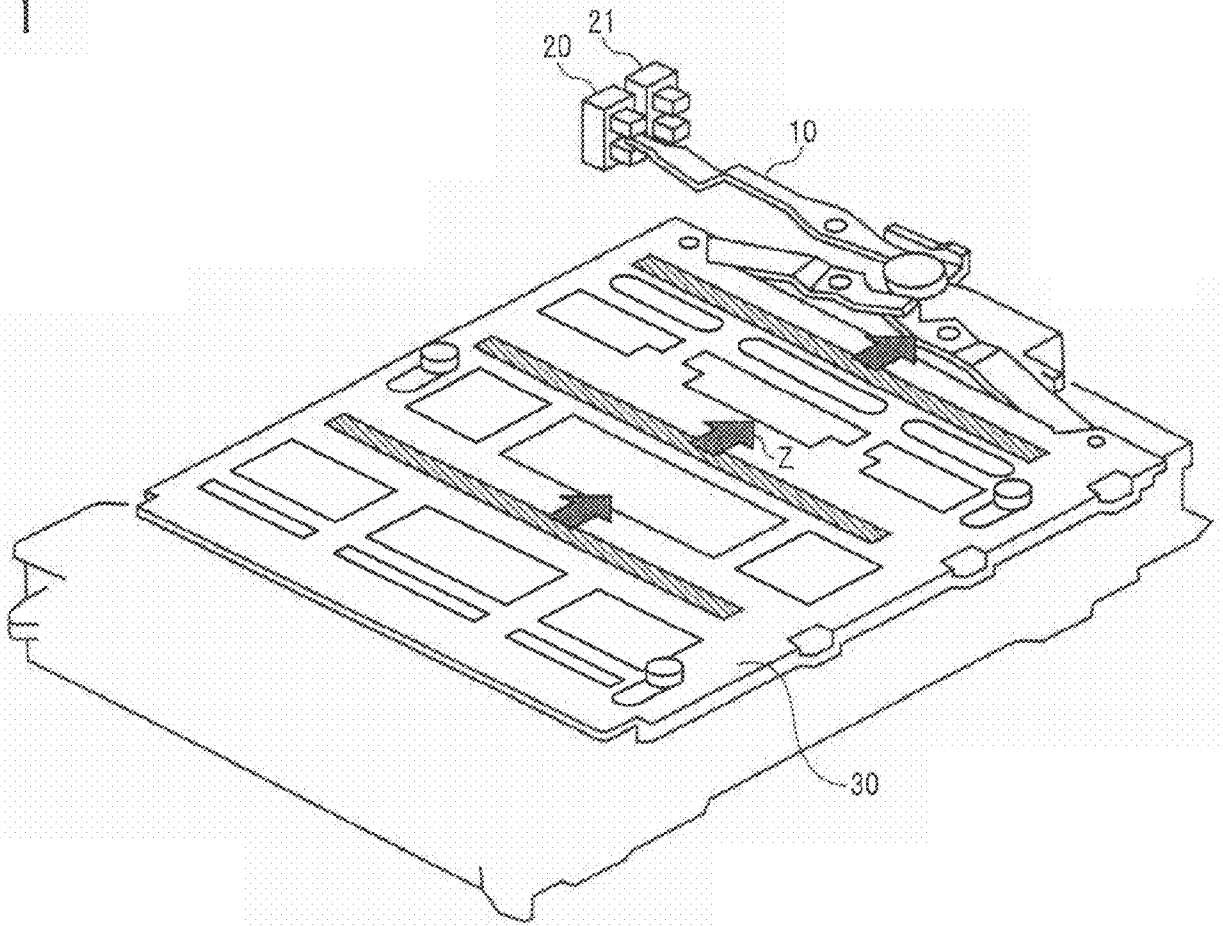
FIG. 1 is a diagram of the conventional hardware configuration of a write unit according to the present embodiment.
Figure 2:
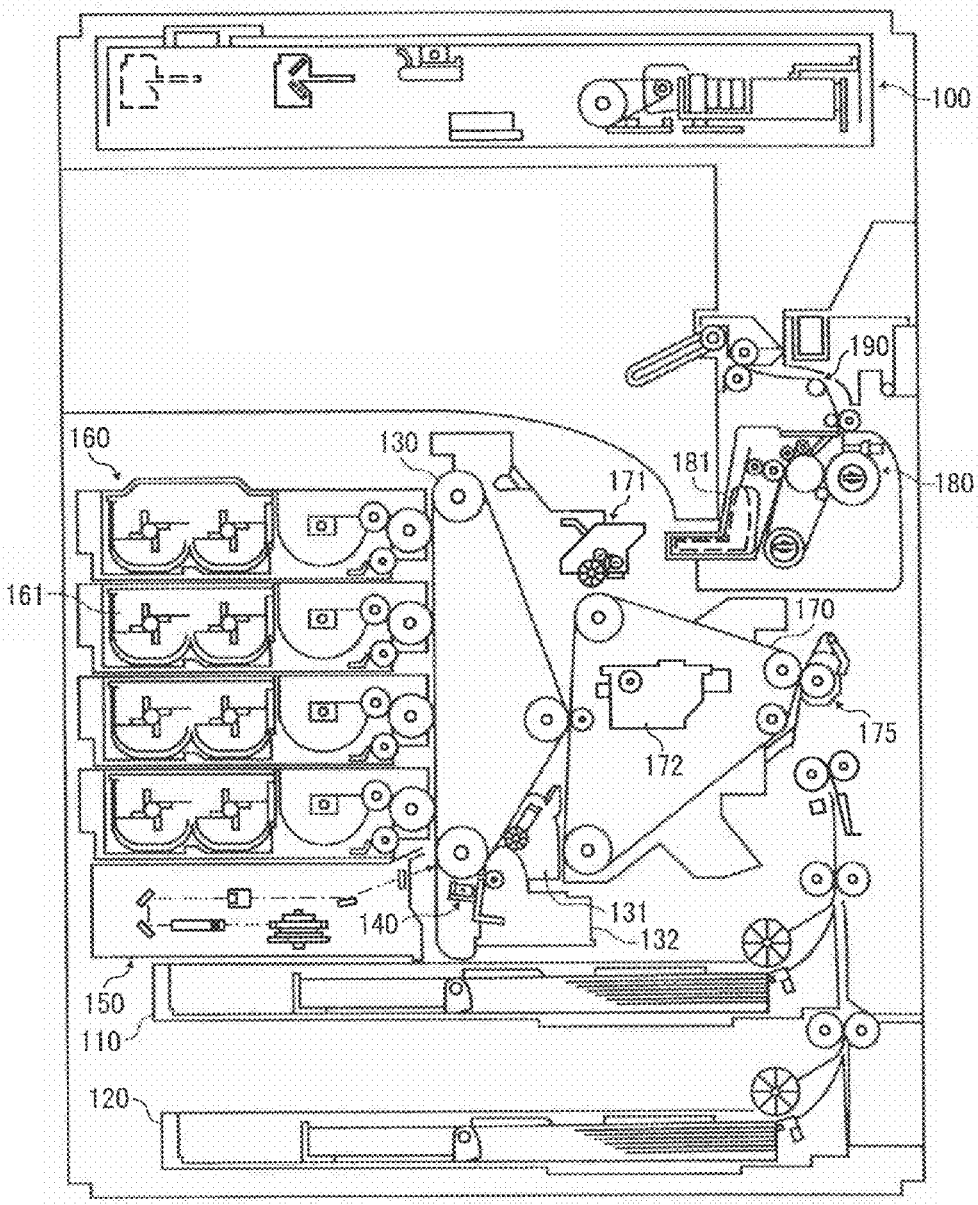
FIG. 2 is a diagram that illustrates an example of the configuration of an image forming apparatus that includes a write device according to the present embodiment.

FIG. 2 is a diagram that illustrates an example of the configuration of an image forming apparatus that includes a write device according to the present embodiment. The image forming apparatus illustrated in FIG. 2 is a digital multifunction product and has a printer function, a scanner function, a FAX function, and a copy function. When in the scanner function, the FAX function, and the copy function, a scanner unit 100 is used to read originals and, when in the FAX function, the copy function, and the printer function, a printer that includes the write device is used to print using print data. In FIG. 2, the printer is a printer that has an electrophotographic system.

The scanner unit 100 includes a plastic or glass transparent platen on which an original is placed, a platen cover to cut off outside light, a light source, and an imaging element that receives light and converts it into an electric signal. The scanner unit 100 can be two types; reflection and transmission. If the scanner unit 100 is a reflection type, light is emitted from the side of the platen and reflected light is received, converted into an electric signal, and output by the imaging element. If the scanner unit 100 is a transmission type, light is emitted from the platen cover and transmitted light is received, converted into an electric signal, and output by the imaging element. Because the electric signal is an analog signal, the signal is converted into a digital signal by an AD converter, and then the digital signal is stored in a storage device until it is subjected to a print process as image data.

The printer includes a first feed tray 110 that contains sheets to be fed and a second feed tray 120 that contains sheets whose size is different from that of the sheets contained in the first feed tray 110.

In order to transfer a developed image onto a sheet fed from the first feed tray 110 or the second feed tray 120, the printer further includes a photoreceptor belt 130, a charge unit 140, a write unit 150, a developing unit 160, an intermediate transfer belt 170, and a secondary transfer unit 175.

The charge unit 140 charges the photoreceptor belt 130. The write unit 150 performs writing to form an electrostatic latent image on the charged surface of the photoreceptor belt 130. The developing unit 160 includes a toner cartridge 161 for each color to develop an electrostatic latent image formed on the surface of the photoreceptor belt 130. A developed image is transferred onto the intermediate transfer belt 170. The secondary transfer unit 175 receives a sheet and transfers the developed image, which has been transferred onto the intermediate transfer belt 170, onto the sheet.

After the image is transferred onto the intermediate transfer belt 170, residual toner on the photoreceptor belt 130 is removed by a photoreceptor cleaning unit 131, and the removed toner is disposed of in a photoreceptor waste-toner bottle 132.

After the image is transferred onto the sheet, residual toner on the intermediate transfer belt 170 is removed by an intermediate-transfer belt cleaning unit 171, and the removed toner is disposed of in an intermediate-transfer waste-toner bottle 172.

The printer further includes a fixing unit 180 that receives the sheet on which the developed image has been transferred and fixes the developed image to the sheet and also includes a discharge unit 190 that discharges the sheet. A fixing-unit applying unit 181 is arranged to separate the sheet, to which the developed image has been fixed by the fixing unit 180, from the fixing unit 180 and is configured to apply a small amount of silicon oil to the fixing unit 180.

A brief explanation is given below of the print process performed by the image forming apparatus (the printer). When the user places an original on the platen, sets the copy size, the number of copies, and the like, and presses a copy start button, a copy start instruction is issued from an undepicted operating unit in the image forming apparatus and the original is read by the scanner unit 100.

The image data read by the scanner unit 100 is sent to the write unit 150 in sequence for each color. After the photoreceptor belt 130 is uniformly charged by the charge unit 140, an LD unit, which is a light source in the write unit 150, irradiates the photoreceptor belt 130 with laser light so as to form an electrostatic latent image for each color on the photoreceptor belt 130.

The electrostatic latent image formed on the photoreceptor belt 130 is developed by the developing unit 160, which includes the toner cartridge 161 corresponding to its color, so that a toner image, which is a developed image, is formed on the photoreceptor belt 130.

The toner image formed on the photoreceptor belt 130 is transferred onto the intermediate transfer belt 170, and the toner image transferred onto the intermediate transfer belt 170 is further transferred onto the sheet, which is fed from the first feed tray 110 or the second feed tray 120, by the secondary transfer unit 175.

Afterwards, the toner image transferred onto the sheet is fixed to the sheet with heat and pressure applied by the fixing unit 180. The sheet to which the toner image is fixed is then discharged to a predetermined position by the discharge unit 190, whereby a copy image is obtained.

Figure 3:
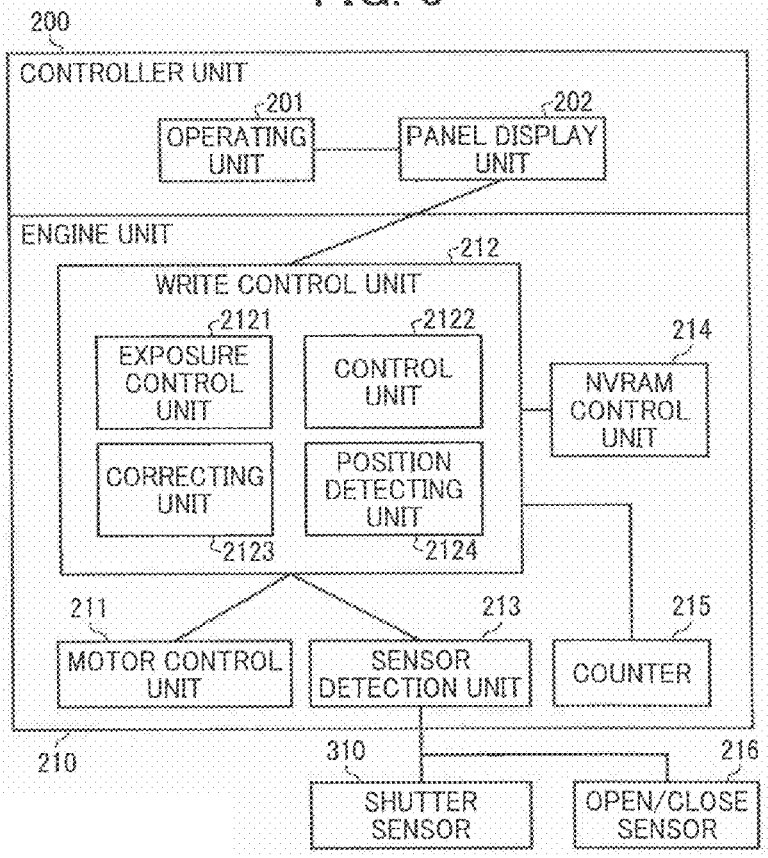
FIG. 3 is a control block diagram of the write unit according to the present embodiment.

The image forming apparatus causes the write unit 150 to irradiate the photoreceptor belt 130 with laser light so as to form an electrostatic latent image on the photoreceptor belt 130; therefore, the image forming apparatus includes a control system, as illustrated in FIG. 3. The control system includes a controller unit 200 and an engine unit 210, as illustrated in FIG. 3.

The controller unit 200 receives image data, analyzes the image data, performs a drawing process, and outputs drawing data. The controller unit 200 includes an operating unit 201 and a panel display unit 202.

The operating unit 201 causes the panel display unit 202 to display a current set value, a selection screen, or the like, and receives an input from a user. The panel display unit 202 functions as an informing unit that displays various errors. The operating unit 201 receives, for example, a set value to change a setting, a copy start instruction, and the like.

The engine unit 210 gives instructions to the write unit 150 for an area on the photoreceptor belt 130 to be irradiated with laser light, or the like, by using drawing data output from the controller unit 200. The engine unit 210 includes a motor control unit 211, a write control unit 212, a sensor detection unit 213, a NVRAM control unit 214, and a counter 215.

The write control unit 212 controls an exposure position or area of laser light, or the like, and stores a set value, or the like, received from the panel display unit 202 in the NVRAM control unit 214. The motor control unit 211 controls the rotation of a polygon motor, a write shutter motor, and the like, which are described later. The sensor detection unit 213 receives input of a detection signal for light shielding by a sensor shielding section 320, which is described later, and notifies the write control unit 212 of the detection signal. The sensor detection unit 213 receives a detection signal (the open state, the closed state) from an open/close sensor 216 that detects the open state and the closed state of an openable and closable cover of a casing of the printer. The sensor detection unit 213 then notifies the write control unit 212 of the detection signal.

The counter 215 measures the time period (detection time period) from when a shutter sensor 310 (described later) detects the predetermined sensor shielding section 320 (described later) until when the shutter sensor 310 no longer detects the sensor shielding section 320.

As illustrated in FIG. 3, the write control unit 212 includes an exposure control unit 2121, a control unit 2122, a correcting unit 2123, and a position detecting unit 2124.

The position detecting unit 2124 determines which one of the sensor shielding sections 320 is the detected sensor shielding section 320 by using the time period measured by the counter 215 and the width of each of the sensor shielding sections 320 and detects the position of a write shutter 260 on the casing of the write unit 150 by using the determined sensor shielding section 320.

In accordance with the position of the write shutter 260, the exposure control unit 2121 controls the emission of laser light from the LD unit, the rotation of a polygon motor 220, and the like, thereby controlling the exposure of the photoreceptor belt 130 to the laser light.

The control unit 2122 controls the on/off switch of the shutter sensor 310, the position detection of the write shutter 260 by the position detecting unit 2124, the rotation of a gear 270 by a write shutter motor 250 and the motor control unit 211, and the time measurement by the counter 215.

The correcting unit 2123 corrects an open-process delay time (a first delay time) and a shielding delay time (a second delay time), which are explained later, by performing an addition or subtraction of an adjustment time.

The detailed process of each of the units is explained later.

Figure 4:
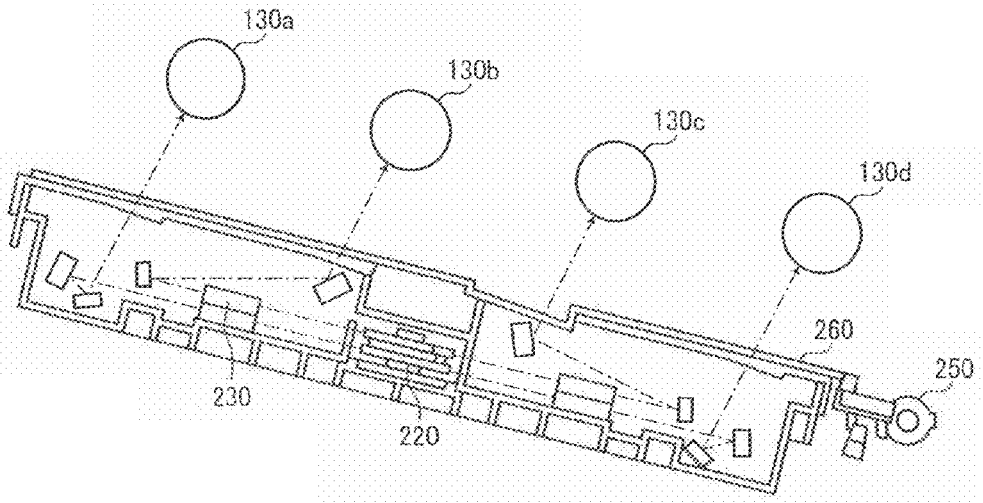
FIG. 4 is a cross-sectional view that illustrates the hardware configuration of the write unit according to the present embodiment.
Figure 5:
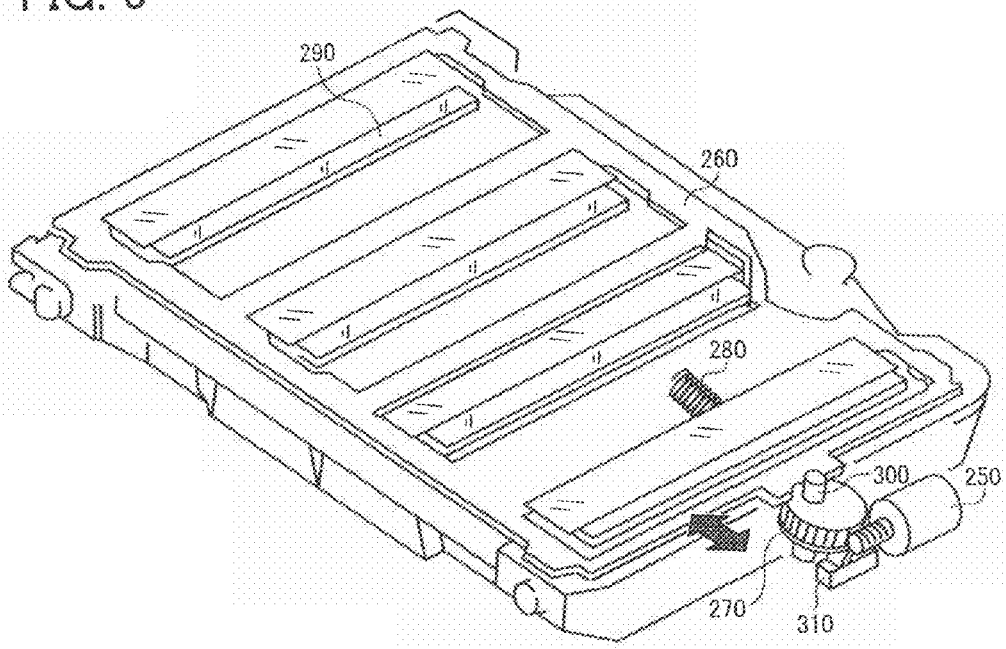
FIG. 5 is a perspective view that illustrates the hardware configuration of the write unit according to the present embodiment.
Figure 6:
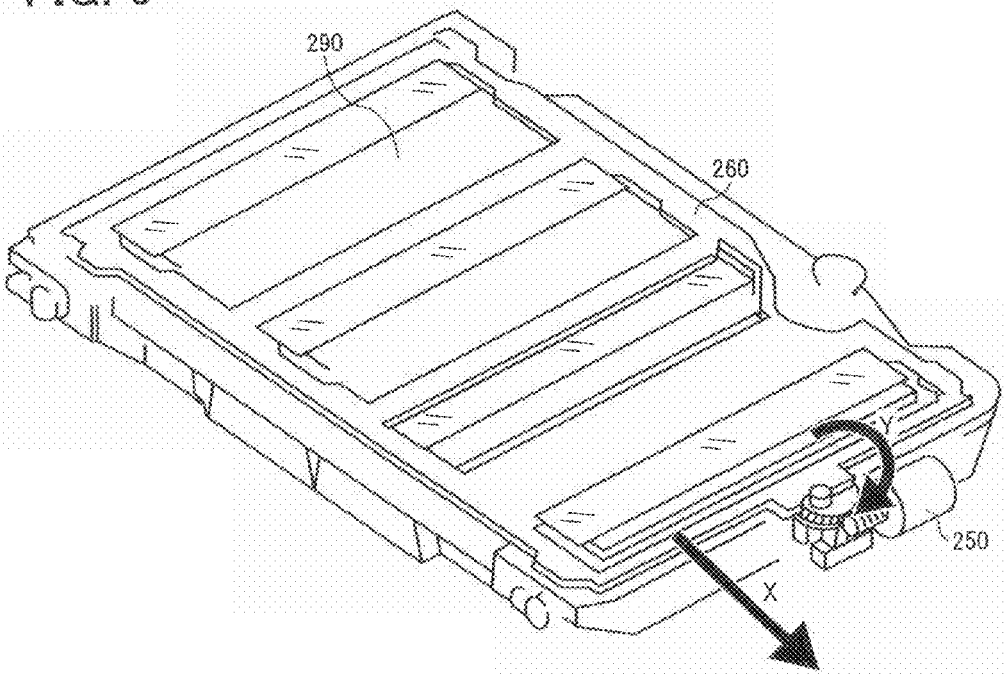
FIG. 6 is a diagram that illustrates the relation between the moving direction of a shutter and the rotation direction of a gear according to the present embodiment.
Figure 7:
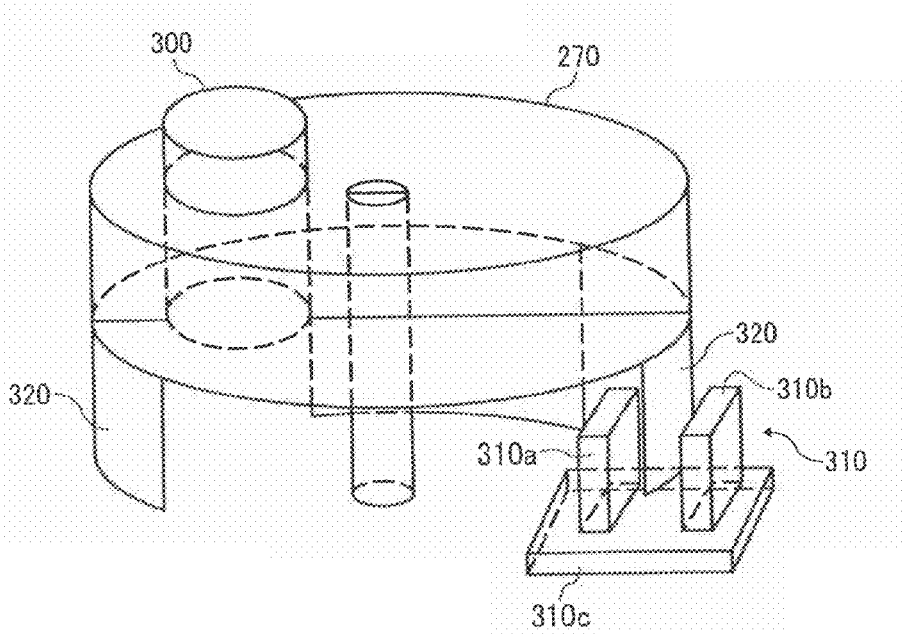
FIG. 7 is a diagram that illustrates an example of the gear included in the write unit according to the present embodiment.
Figure 8:
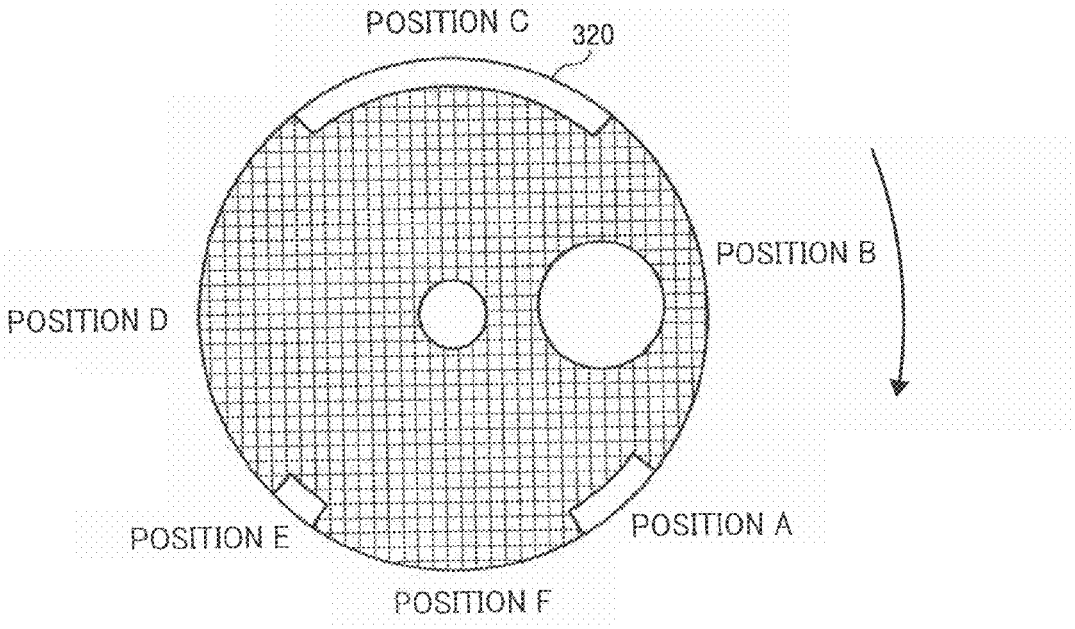
FIG. 8 is a diagram that illustrates the positional relationship of sensor shielding sections included in the gear according to the present embodiment.

FIGS. 4 to 6 are diagrams that illustrate the mechanical structure of the write unit 150. FIG. 7 is an enlarged view of a gear that is a rotator included in the write unit 150. FIG. 8 is a diagram that illustrates the positional relationship of the sensor shielding sections that are wall-like sections included in the gear in a detailed manner.

The write unit 150 includes, as a hardware configuration, the polygon motor 220, an fθ lens 230, the LD unit, the write shutter motor 250 that is a drive unit, the write shutter 260, the gear 270, a spring 280, a window 290 that is an opening, a roller 300, the shutter sensor 310, and the sensor shielding sections 320. The window 290 is formed as an opening on the top surface of the casing of the write unit 150 so that laser light emitted from the LD unit is transmitted and the photoreceptor belt 130 arranged outside the write unit 150 is irradiated with the light. An undepicted dust preventing member is arranged on the window 290 to prevent foreign substances, such as paper dust or toner supplied from the developing unit at the developing stage after exposure, from getting inside the write device, whereby foreign substances are prevented from getting inside the write unit 150. The dust preventing member is a transparent optical element, inorganic glass, or the like, which allows the passage of laser light.

The polygon motor 220 rotates a polygon mirror at a high speed so as to scan the photoreceptor belt 130 with the laser light emitted from the LD unit. The fθ lens 230 collects the laser light deflected by the polygon mirror and corrects the scan speed to a constant scan speed. The LD unit includes a laser diode so that laser light is emitted and stopped by using information received from the write control unit 212 included in the engine unit 210.

The write shutter motor 250 rotates the gear 270 so as to move the write shutter 260. The write shutter 260 is a shielding plate that functions as a shutter unit. The write shutter 260 is movably mounted on the casing of the write unit 150 so as to open and close the window 290 as it moves. The write shutter 260 is used to shield laser light by putting the window 290 in the closed state during an operation such as an emergency stop. The gear 270 is a disk-shaped rotator that is rotated by the drive of the write shutter motor 250. Concave and convex portions are formed on its circumference and fitted into concave and convex portions formed on the rotary shaft arranged on the end of the write shutter motor 250 so that the gear 270 is rotated in accordance with the rotation of the rotary shaft.

The roller 300, which is mounted on the gear 270, protrudes from one side of the gear 270 and is in pressure contact with the write shutter 260 due to the spring 280. The position of the roller 300 is changed in accordance with the rotation of the gear 270. The spring 280 acts to push the write shutter 260 so as to retain the state where the roller 300 and the write shutter 260 are in pressure contact with each other. If the gear 270 is rotated to change the position of the roller 300, the position of the write shutter 260 is also changed, whereby the window 290 is opened and closed. Specifically, the write shutter 260 is moved in accordance with the rotation of the gear 270 so that the window 290 is opened and closed. A coil spring, a plate spring, or the like can be used as the spring 280. Not only a spring but also rubber may be used.

A brief explanation is given of the operation of the write unit 150. If an instruction is received from the exposure control unit 2121 of the engine unit 210, laser light is emitted from the LD unit, and the laser light is reflected by the polygon mirror included in the polygon motor 220. The reflected laser light is collected by the fθ lens 230, and photoreceptors 130*a* to 130*d* are scanned with the light via a reflection mirror so that the surface of each of the photoreceptors 130*a* to 130*d* is exposed to the light. Here, the photoreceptors 130*a* to 130*d* corresponding to respective colors are illustrated, not the photoreceptor belt 130.

The write shutter 260 is a dust preventing device to prevent adherence of toner. During a writing operation, the write shutter 260 puts the window 290 in the open state in order to irradiate the photoreceptors 130*a* to 130*d* with laser light and put the write shutter 260 in the stopped state by using the roller 300.

As illustrated in FIG. 6, if the write shutter motor 250 is driven, the gear 270 is rotated. Because of the rotation of the gear 270, the position of the roller 300, which is located on the upper section of the gear 270, is changed. If the position of the roller 300 is changed by being moved in the direction of the arrow Y, the write shutter 260 is pushed in the direction of the arrow X due to the exerted force of the spring so that the window 290 is then shielded. If the gear 270 continues to rotate, the write shutter 260 is moved back and forth so that the window 290 can be opened and closed.

As illustrated in FIG. 7, the shutter sensor 310, which is a detecting unit, includes two plate-like members, i.e., a light source 310*a* and a receiving unit 310*b*, that are arranged parallel to each other on a board 310*c*. In the shutter sensor 310, light emitted by the light source 310*a* is received by the receiving unit 310*b* so that the light is detected. On the edge of the surface of the gear 270, which is opposed to the shutter sensor 310, i.e., the edge of the surface perpendicular to the rotary shaft of the gear 270, the sensor shielding sections 320, which are wall-like sections each extending downward from the surface, are arranged in a standing manner. If the sensor shielding section 320 passes between the light source 310*a* and the receiving unit 310*b* in accordance with the rotation of the gear 270, light is cut off during that time and the receiving unit 310*b* cannot detect the light. Specifically, the sensor shielding section 320 interrupts detection of the light from the light source 310*a* of the shutter sensor 310. while the sensor shielding section 320 passes by, the shutter sensor 310 can detect light shielding because the light is cut off and, before or after the sensor shielding section 320 passes by, the shutter sensor 310 can detect exposure because the light is detected. Thus, the shutter sensor 310 detects presence or absence of the sensor shielding sections 320.

As illustrated in FIG. 8, the wall-like sensor shielding sections 320, each having a different width, are mounted on the edge of the back side of the surface where the roller 300 of the gear 270 is arranged, and the shielding state is obtained by monitoring of the shutter sensor 310. Specifically, the counter 215 (see FIG. 3) measures the time period from when the shutter sensor 310 detects one of the sensor shielding sections 320 until when the shutter sensor 310 no longer detects the sensor shielding section 320, the sensor shielding section 320 is identified using the measured time period, and the current position of the write shutter 260 is detected using the position of the identified sensor shielding section 320. The counter may be implemented as hardware or software.

As illustrated in FIG. 8, the three sensor shielding sections 320 are arranged. The position of the sensor shielding section 320 with the largest width is the position C, the position of the sensor shielding section 320 with the second largest width is the position A, the position of the sensor shielding section 320 with the smallest width is the position E, and the positions between these positions are the position B, the position F, and the position D. When the position C is detected, the window 290 is in the open state and, when the position F, which is opposed to the position C, is detected, the window 290 is in the closed state.

With such a configuration, the position of the write shutter 260 can be determined using one shutter sensor 310, whereby the number of sensors can be reduced.

Figure 9:
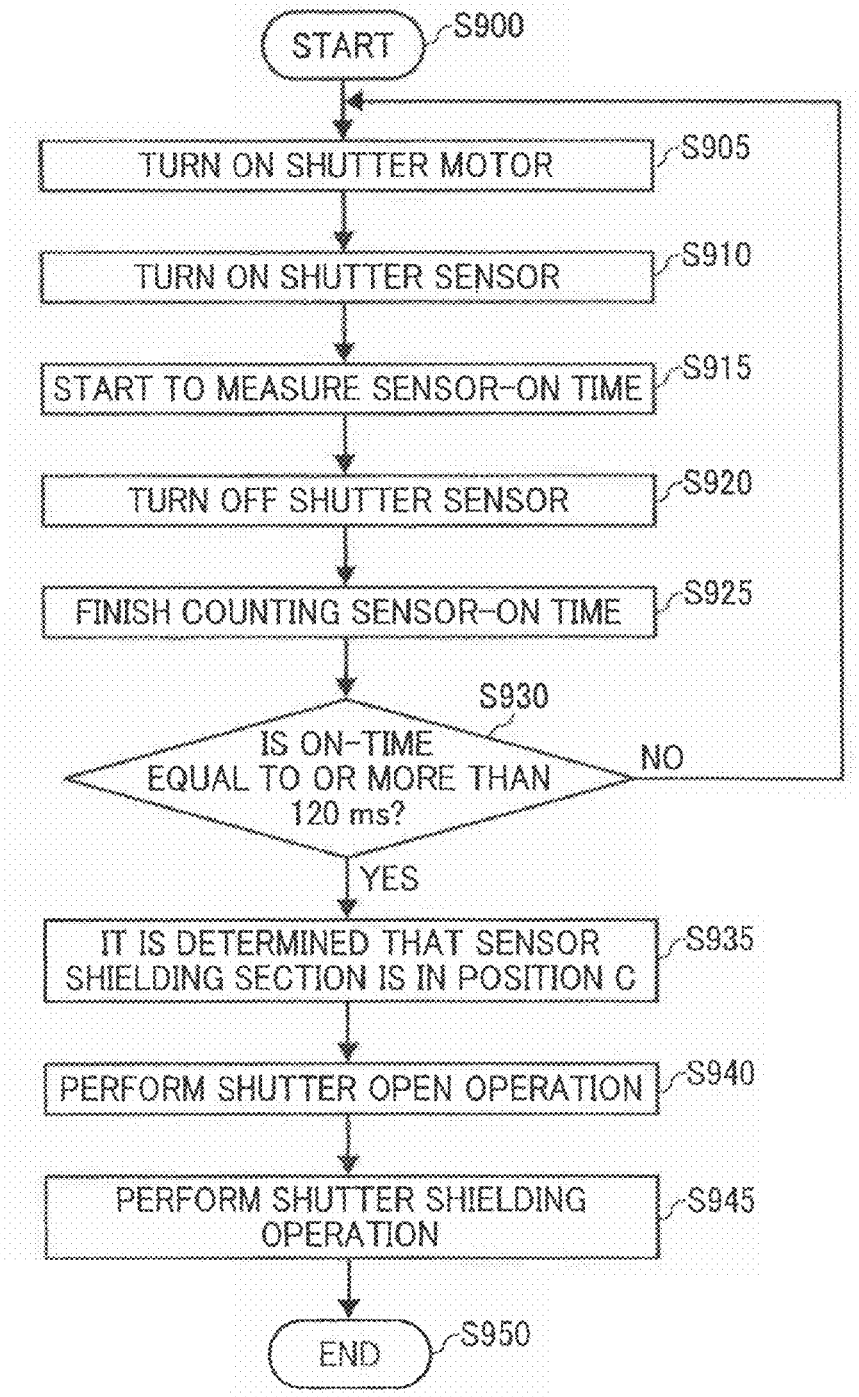
FIG. 9 is a flowchart that illustrates the procedure of the initializing process according to the present embodiment.

Next, a detailed explanation is given of the control performed by the write unit 150. First, an explanation is given of an initializing process with reference to FIG. 9. FIG. 9 is a flowchart that illustrates the procedure of the initializing process.

When the power of the write unit 150 is turned on, the position of the gear 270 is unknown; therefore, it is necessary to determine the initial position of the gear 270 and, if it is not at the appropriate position, move the gear 270 to the appropriate position, thereby performing initial adjustment. The process of performing the initial adjustment is the initializing process.

The initializing process is started at Step S900, and the motor control unit 211 turns on the write shutter motor 250 to drive it at Step S905 so that the gear 270 is rotated. At Step S910, the control unit 2122 turns on the shutter sensor 310, and the sensor detection unit 213 detects cutoff of light by the sensor shielding section 320, i.e., light shielding.

At Step S915, the counter 215 starts to measure the time period from when the light shielding is detected until when the light from the light source, i.e., the exposure is detected after the passage of the sensor shielding section 320. At Step S920, the control unit 2122 turns off the shutter sensor 310 when the exposure is detected. Then, at Step S925, the counter 215 finishes measuring the sensor-on time during which the shutter sensor 310 is on. At Step S930, the position detecting unit 2124 determines whether the sensor-on time, i.e., the detection time period of the light shielding by the sensor shielding section 320, is equal to or more than 120 ms (millisecond). The position detecting unit 2124 compares the value of 120 ms, which is a parameter stored in the NVRAM control unit 214, with the measured time period so that the above determination is performed. The value of 120 ms is obtained by allowing for the time period for which the position C of the sensor shielding section 320 is detected by the shutter sensor 310; however, the present invention is not limited to this. The determination described below is also performed in the same manner by the position detecting unit 2124 or the control unit 2122 of the write control unit 212 using the detection result obtained by the shutter sensor 310.

If the measured time period is equal to or more than 120 ms, the process control proceeds to Step S935 so that it is determined that the passed sensor shielding section 320 is in the position C illustrated in FIG. 8. As described above, when in the position C, it means that the roller 300 is located on the side of the write shutter 260 and is in the position such that the window 290 is exposed, as illustrated in FIG. 5.

Conversely, if the measured time period is less than 120 ms, the process control proceeds to Step S905. Because the time period from when the light shielding is detected until when the exposure is detected is less than the time period for which the sensor shielding section 320 in the position C passes by the shutter sensor 310, the control unit 2122 controls the on/off switch of the shutter sensor 310, the position detection of the write shutter 260 by the position detecting unit 2124, the rotation of the gear 270 by the write shutter motor 250 and the motor control unit 211, and the time measurement by the counter 215, whereby the process from Step S905 to Step S930 is repeated until the time period from when the light shielding is detected until when the exposure is detected is equal to or more than the time period for which the sensor shielding section 320 in the position C passes by the shutter sensor 310.

If it is determined that the sensor shielding section 320 is in the position C at Step S935, the process control proceeds to Step S940 so that the shutter open operation is performed. The details of the shutter open operation are described later. If the shutter open operation is finished, the process control proceeds to Step S945 so that the shutter shielding operation is sequentially performed. The details of the shutter shielding operation are also described later.

After the shutter shielding operation is finished, the process control proceeds to Step S950 so that the initializing process is finished.

Figure 10:
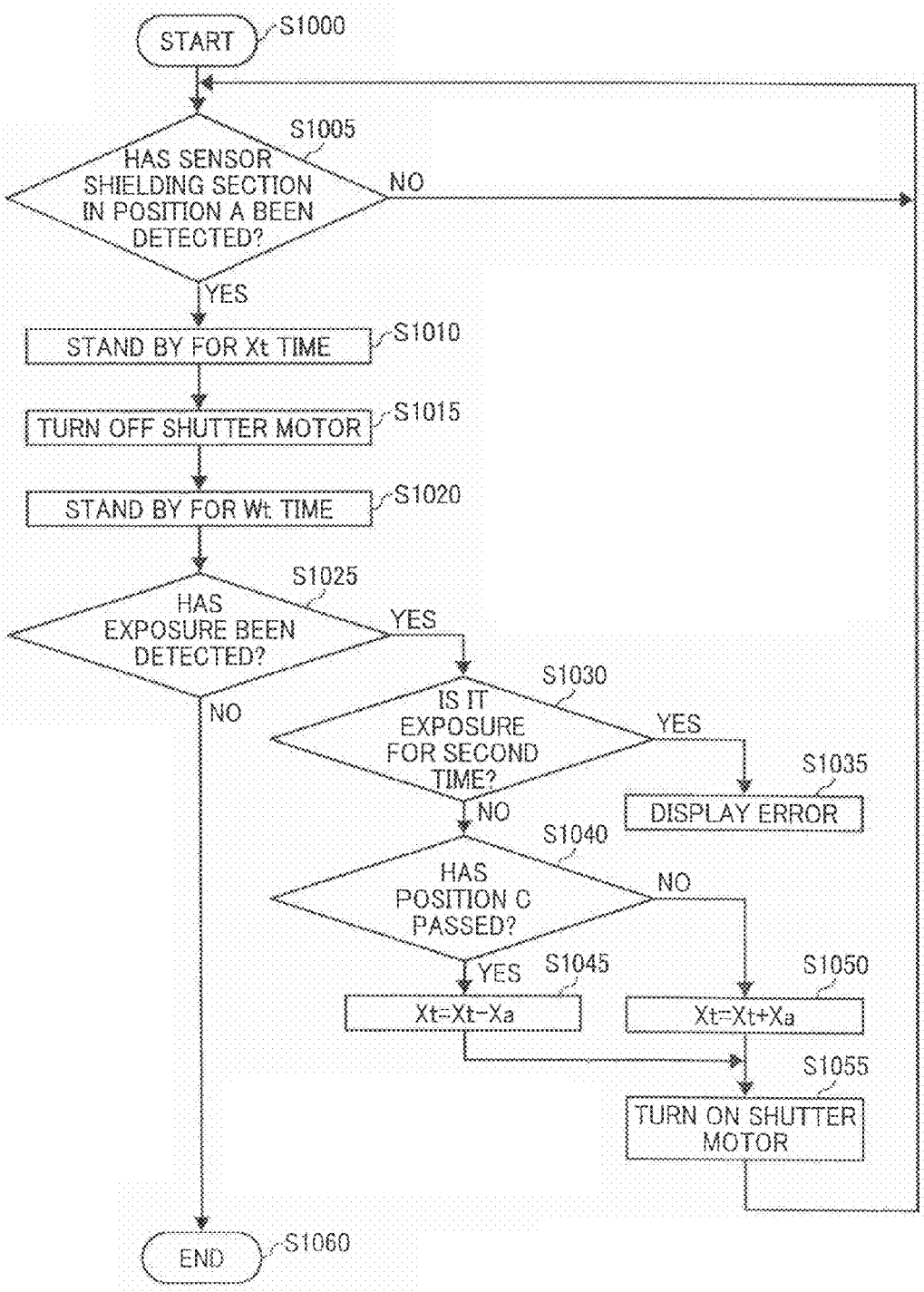
FIG. 10 is a flowchart that illustrates the procedure of the shutter open operation according to the present embodiment.

An explanation is given of the shutter open operation with reference to FIG. 10. If the shutter open operation is performed, the window 290 is in the open state, whereby the exposure to the photoreceptor belt 130 by the write unit 150 can be appropriately performed.

The shutter open operation is started at Step S1000, and the sensor shielding section 320 in the position A illustrated in FIG. 8 is detected by the shutter sensor 310 at Step S1005. The determination at Step S1005 is repeated until the sensor shielding section 320 in the position A is detected.

If the shutter sensor 310 detects the position A of the sensor shielding section 320, the process control proceeds to Step S1010 using the detection as a trigger so that the control unit 2122 stands by for an open delay time (Xt) that is the first delay time by which the write shutter 260 puts the window 290 in the open state. Afterwards, the process control proceeds to Step S1015 so that the motor control unit 211 turns off the write shutter motor 250 so as to stop the write shutter motor 250. Then, at Step S1020, the control unit 2122 stands by for a reaction determination time (Wt) that is from when the write shutter motor 250 is turned off until when the write shutter motor 250 is actually stopped. Afterwards, the process control proceeds to Step S1025 so that the position detecting unit 2124 determines whether the shutter sensor 310 has detected the exposure. If the exposure has been detected, the state is not such that the light from the light source of the shutter sensor 310 is cut off by the sensor shielding section 320; therefore, the process control proceeds to Step S1030 so that the position detecting unit 2124 determines whether it is the exposure for the second time. If it is the exposure for the second time, it is recognized as a hardware failure; therefore, the process control proceeds to Step S1035 so that the write control unit 212 notifies the panel display unit 202 of the failure.

If it is not the exposure for the second time, the process control proceeds to Step S1040 so that the position detecting unit 2124 determines whether the sensor shielding section 320 in the position C has passed by the shutter sensor 310. The counter 215 measures the time period for which the sensor shielding section 320 in the position C passes by the shutter sensor 310 so that the passage of sensor shielding section in the position C can be detected. If it is determined that the position C of the sensor shielding section 320 has passed by the shutter sensor 310, it means it has passed by because the Xt time is too long; therefore, the process control proceeds to Step S1045 so that the correcting unit 2123 subtracts Xa time, which is the open adjustment time, from the Xt time, thereby correcting the Xt time. Then, the motor control unit 211 turns on the write shutter motor 250 at Step S1055, and then the process control returns to Step S1005 so that the shutter open operation is performed again.

Conversely, if it is determined that the sensor shielding section in the position C has not passed by the shutter sensor 310, it means it has not reached the position C because the Xt time is too short; therefore, the process control proceeds to Step S1050 so that the correcting unit 2123 adds the Xa time to the Xt time, thereby correcting the Xt time. Then, the motor control unit 211 turns on the write shutter motor 250 at Step S1055, and the process control returns to Step S1005 so that the shutter open operation is performed again.

The Xa time can be specified optionally by the user using the operating unit 201 and stored in the NVRAM control unit 214 via the panel display unit 202 and the write control unit 212 so that it can be used for the above calculation.

Figure 11:
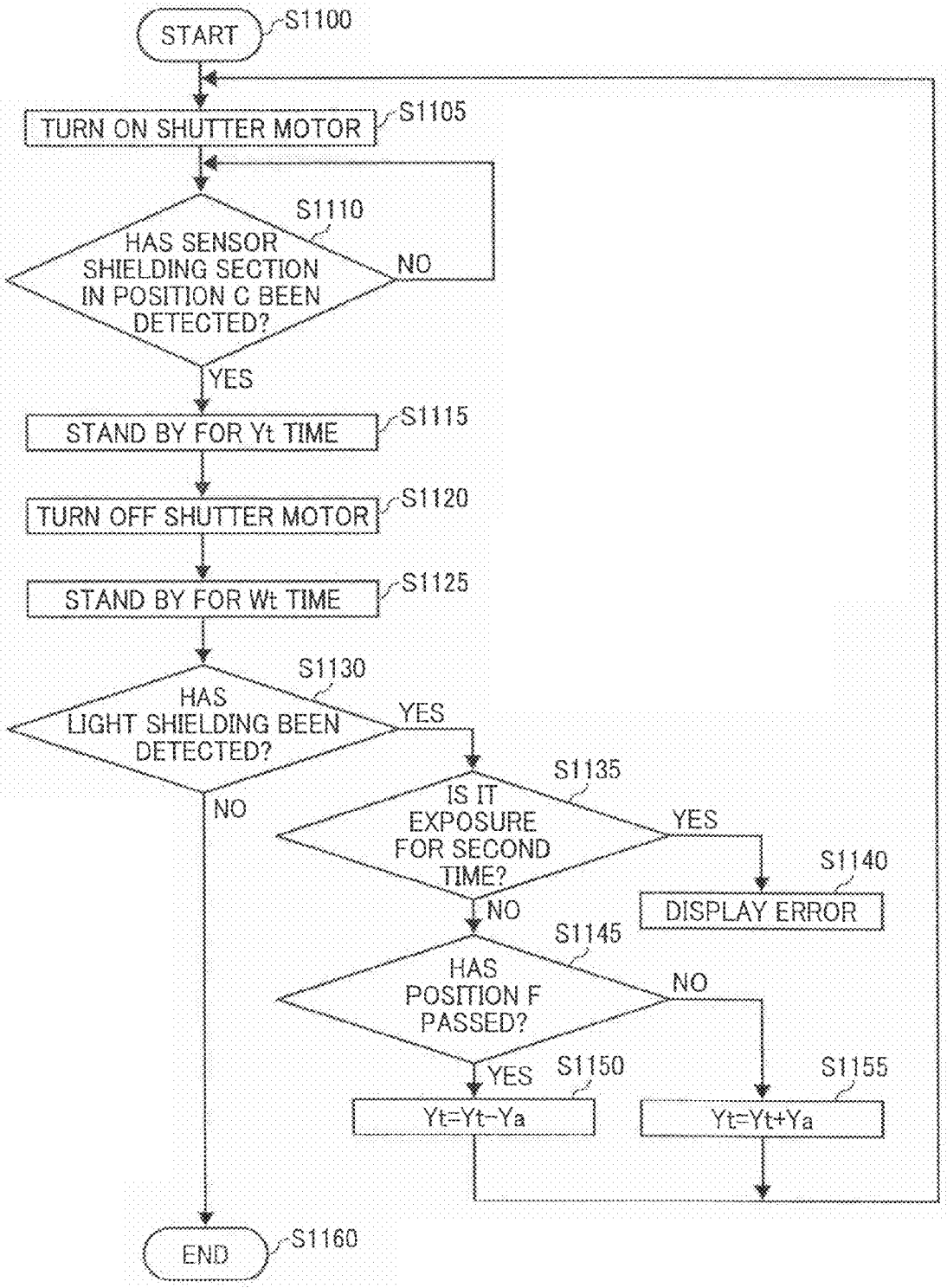
FIG. 11 is a flowchart that illustrates the procedure of the shutter shielding operation according to the present embodiment.

If the exposure has not been detected at Step S1025, it is determined that light shielding is occurring because it is in the position C; therefore, the process control proceeds to Step S1060 so that the shutter open operation is finished. Subsequent to the end of the shutter open operation, the shutter shielding operation described below is performed. FIG. 11 is a flowchart that illustrates the procedure of the shutter shielding operation.

The shutter shielding operation is started at Step S1100, and the motor control unit 211 turns on the write shutter motor 250 to drive the write shutter motor 250 at Step S1105. Next, at Step S1110, the position detecting unit 2124 determines whether the shutter sensor 310 has detected the sensor shielding section 320 in the position C. At Step S1110, the control unit 2122 controls the determination process performed by the position detecting unit 2124 so as to be repeated until the shutter sensor 310 detects the sensor shielding section 320 in the position C. If the sensor shielding section 320 in the position C is detected, the process control proceeds to Step S1115 so that the control unit 2122 stands by for a shielding delay time (Yt) that is the second delay time by which the write shutter 260 puts the window 290 in the closed state. At Step S1120, the motor control unit 211 turns off the write shutter motor 250 to stop it.

Next, after a stand by for the reaction determination time Wt at Step S1125, the position detecting unit 2124 determines whether the shutter sensor 310 has detected the light shielding by the sensor shielding section 320 at Step S1130. If the light shielding has been detected, the process control proceeds to Step S1135 so that it is determined whether it is the light shielding for the second time. If it is the light shielding for the second time, it is recognized as a hardware failure, and the process control proceeds to Step S1140 so that the write control unit 212 notifies the panel display unit 202 of the failure.

If it is not the light shielding for the second time, the process control proceeds to Step S1145 so that the position detecting unit 2124 determines whether the position F of the sensor shielding section 320 has passed by the shutter sensor 310. The counter 215 measures the time period from when the sensor shielding section 320 in the position E passes by the shutter sensor 310 until when the sensor shielding section 320 in the position A is detected so that the passage of the position F can be detected. If it is determined that the position F of the sensor shielding section 320 has passed by the shutter sensor 310, it means it has passed by because the Yt time is too long; therefore, the process control proceeds to Step S1150 so that the correcting unit 2123 subtracts Ya time, which is shielding adjustment time, from the Yt time, thereby correcting the Yt time. Then, the process control returns to Step S1105 so that the shutter shielding operation is performed again.

Conversely, if it is determined that the position F of the sensor shielding section 320 has not passed by the shutter sensor 310, it means it has not reached the position F because the Yt time is too short; therefore, the process control proceeds to Step S1155 so that the correcting unit 2123 adds the Ya time to the Yt time, thereby correcting the Yt time. Then, the process control returns to Step S1105 so that the shutter shielding operation is performed again.

The Ya time can be specified optionally by the user using the operating unit 201 and stored in the NVRAM control unit 214 via the panel display unit 202 and the write control unit 212. In the same manner, the Wt time can be specified optionally by the user and stored in the NVRAM control unit 214 so that it can be used for the above calculation.

If the light shielding has not been detected at Step S1130, the position detecting unit 2124 determines that there is exposure because the position F of the sensor shielding section 320 is passing by the shutter sensor 310; therefore, the process control proceeds to Step S1160 so that the shutter shielding operation is finished.

Figure 12:
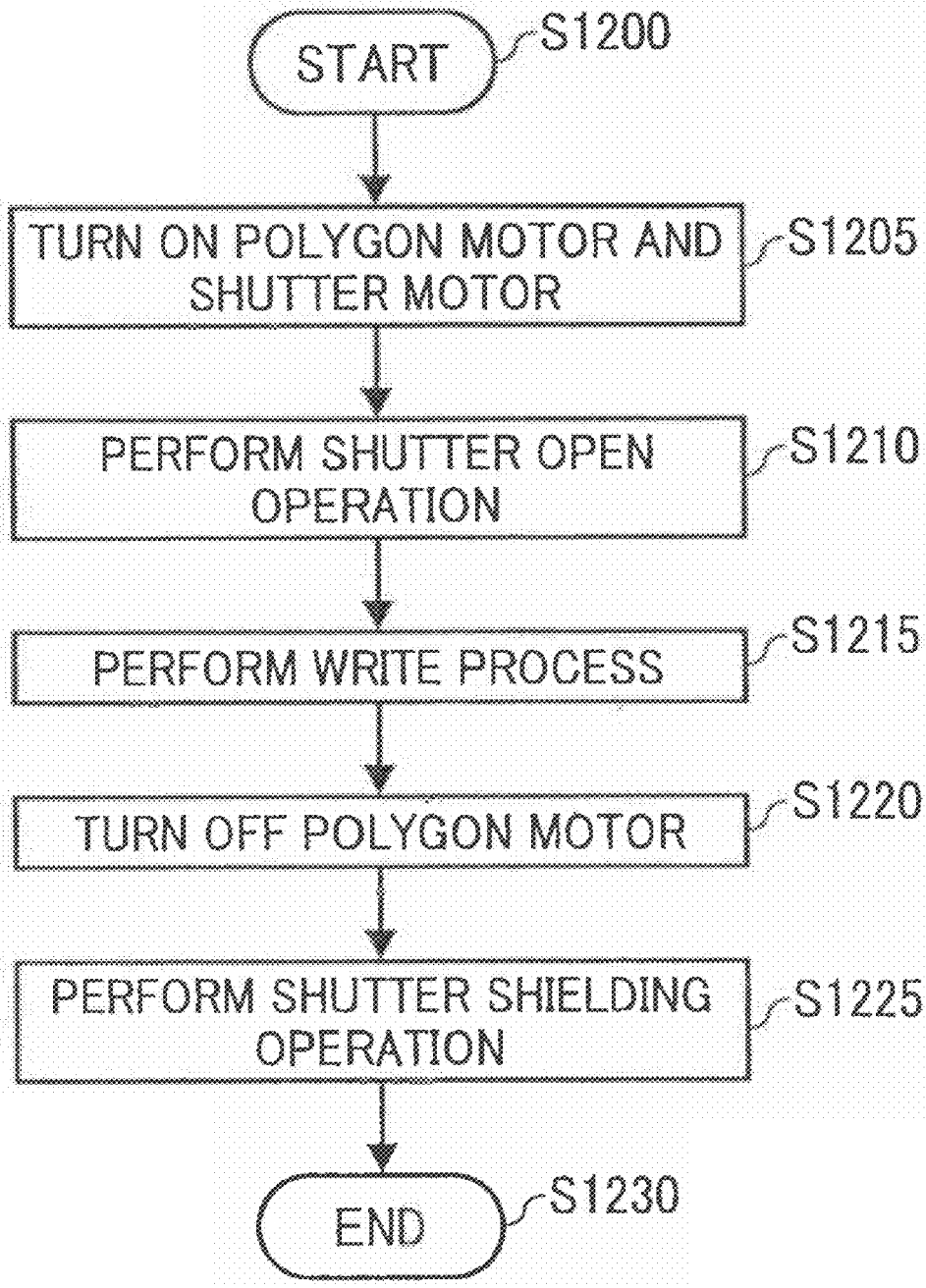
FIG. 12 is a flowchart that illustrates the procedure of the write control according to the present embodiment.

Next, an explanation is given of the procedure of the write control with reference to FIG. 12. The write control is started at Step S1200, and, at Step S1205, the motor control unit 211 turns on the polygon motor 220 to drive it and also turns on the write shutter motor 250 to drive it in synchronization with the polygon motor 220.

At Step S1210, the shutter open operation is performed as illustrated in FIG. 10. After detecting the sensor shielding section 320 in the position C and determining that the window 290 is in the open state, the write process is performed at Step S1215. In the write process, the exposure control unit 2121 of the write unit 150 causes the LD unit to irradiate the photoreceptor belt 130 with laser light so as to form an electrostatic latent image, and the electrostatic latent image is developed to form a developed image.

When the write process is finished, the motor control unit 211 turns off the polygon motor 220 to stop it at Step S1220, and the shutter shielding operation is performed at Step S1225, as illustrated in FIG. 11. In this operation, after the position F of the sensor shielding section 320 is detected and it is determined that the window 290 is in the closed state, the write control is finished at Step S1230.

Figure 13:
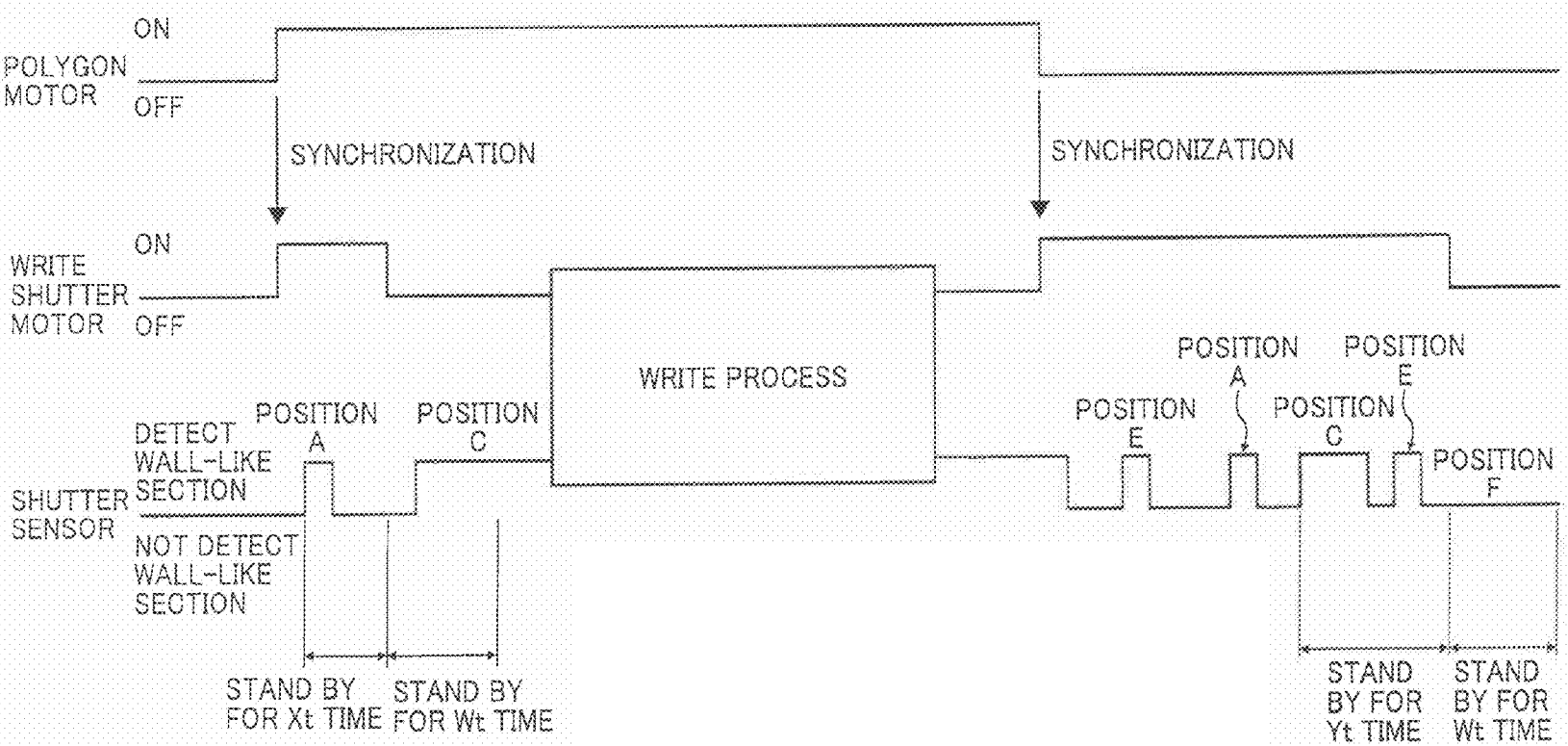
FIG. 13 is a sequence diagram that illustrates the state of each motor and sensor in the write control according to the present embodiment.

The state of each of the motors and the sensor in the write control illustrated in FIG. 12 is depicted in FIG. 13. The polygon motor 220 and the write shutter motor 250 are started in synchronization and, if the position A is detected by the shutter sensor 310, there is a stand by for the Xt time after the detection. Afterwards, there is a stand by for the Wt time and, after it is determined that it is in the position C that indicates that the window 290 is in the open state, the write process is performed.

When the write process is finished, the motor control unit 211 stops the polygon motor 220 and the write shutter motor 250 in synchronization and, if the shutter sensor 310 detects the position C, there is a stand by for the Yt time after the detection. Afterwards, there is a stand by for the Wt time and, after it is determined that it is in the position F that indicates that the window 290 is in the closed state, the write control is finished.

In the image forming apparatus, the write device is mounted within the casing that includes the openable and closable cover. If the cover is opened when a sheet to be conveyed is jammed, there is a possibility that the photoreceptor belt 130, or the like, is moved by the user. At that time, toner can adhere to the window 290. Therefore, in this case, the motor control unit 211 needs to perform the shutter shielding operation.

Figure 14:
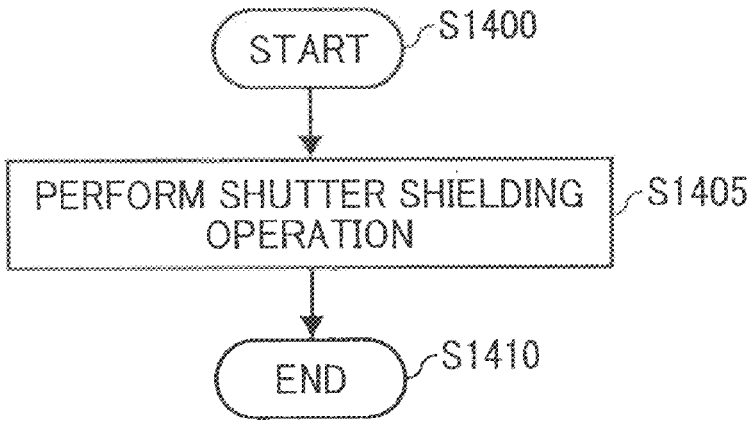
FIG. 14 is a flowchart that illustrates the procedure of the process performed when a door is opened according to the present embodiment.

As illustrated in FIG. 14, the open/close sensor 216 detects that the cover is in the open state, the process is started at Step S1400 in response to an instruction from the control unit 2122, and the shutter shielding operation illustrated in FIG. 11 is performed at Step S1405. If the window 290 gets tainted due to adherence of toner, the exposure cannot be performed appropriately; therefore, to prevent this, the window 290 is closed if the cover is opened. If the shutter shielding operation is finished, the process is finished at Step S1410.

Figure 15:
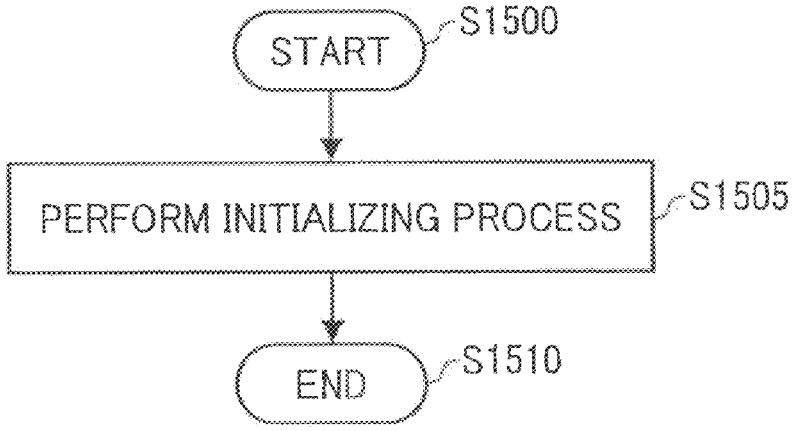
FIG. 15 is a flowchart that illustrates the procedure of the process performed when a door is closed according to the present embodiment.

After the cover is opened to remove the jammed sheet, the cover is closed; however, there is a possibility that the position of the write shutter 260 is not set in the fixed position. Therefore, as illustrated in FIG. 15, the open/close sensor 216 detects that the cover is in the closed state, the process is started at Step S1500 in response to an instruction from the control unit 2122, and the initializing process illustrated in FIG. 9 is performed at Step S1505. After the position of the write shutter 260 is adjusted by the initializing process and the adjustment is finished, the process is finished at Step S1510.

Thus, according to the present invention, the write device and the image forming apparatus can be provided at a low cost by decreasing the number of sensors so as to simplify the structure or the procedure and reduce the cost.

An open/close control program to be executed by the printer according to the present embodiment is provided by being installed on a ROM, or the like, in advance.

A configuration may be such that an open/close control program to be executed by the printer according to the present embodiment is provided by being stored, in the form of a file that is installable and executable, in a recording medium readable by a computer, such as a CD-ROM, a flexible disk (FD), a CD-R, or a Digital Versatile Disk (DVD).

Furthermore, a configuration may be such that an open/close control program to be executed by the printer according to the present embodiment is stored in a computer connected via a network such as the Internet and provided by being downloaded via the network. Moreover, a configuration may be such that an open/close control program to be executed by the printer according to the present embodiment is provided or distributed via a network such as the Internet.

An open/close control program executed by the printer according to the present embodiment has a module configuration including each of the units described above (the exposure control unit 2121, the control unit 2122, the correcting unit 2123, the position detecting unit 2124, and the like) and, as actual hardware, a CPU (processor) reads the open/close control program from the ROM and executes the read program so as to load each of the units described above into a main storage so that the exposure control unit 2121, the control unit 2122, the correcting unit 2123, the position detecting unit 2124, and the like are generated in the main storage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A write device comprising:

an opening that is arranged on a casing that houses a light source that emits irradiation light to expose a photoreceptor, the opening allowing passage of the irradiation light;

a shutter unit that is movably mounted on the casing and is moved to open and close the opening;

a rotator that moves the shutter unit in accordance with rotation;

a drive unit that rotates the rotator;

a plurality of wall-like sections, each wall-like section having a different width and being arranged in a standing manner on a side intersecting with a rotary shaft of the rotator;

a detecting unit that detects each of the wall-like sections that are moved in accordance with the rotation of the rotator;

a measuring unit that measures a detection time period from when a wall-like section of the plurality of wall-like sections is detected until when the wall-like section is no longer detected;

a position detecting unit that determines which one of the wall-like sections is the detected wall-like section by using the measured detection time period and the width of each of the wall-like sections and detects a position of the shutter unit on the casing by using the determined wall-like section; and an exposure control unit that controls exposure in accordance with the position of the shutter unit.

2. The write device according to claim 1, further comprising a control unit that controls the drive unit, the detecting unit, and the measuring unit, wherein the position detecting unit determines whether the shutter unit is located in a predetermined initial position by using the measured time period and the width of each of the wall-like sections, and the control unit controls the drive unit so as to rotate the rotator, the detecting unit so as to detect the wall-like sections, and the measuring unit so as to measure the detection time period until it is determined that the shutter unit is located in the initial position.

3. The write device according to claim 2, the control unit controlling the drive unit so as to rotate the rotator until a predetermined first delay time elapses after the detecting unit detects a predetermined first wall-like section included in the wall-like sections and so as to stop the rotation of the rotator when the first delay time elapses, and the position detecting unit determining, depending on whether the detecting unit has detected the first wall-like section, whether the shutter unit is located in a position to open the opening, the write device further comprising a correcting unit that corrects the first delay time if it is determined that the shutter unit is not located in the position to open the opening.

4. The write device according to claim 3, further comprising an input receiving unit that receives input of a first adjustment time from a user, wherein the correcting unit corrects the first delay time by using the first adjustment time, the control unit controls the drive unit so as to rotate the rotator until a corrected first delay time elapses after the detecting unit detects the first wall-like section and so as to stop the rotation of the rotator when the corrected first delay time elapses, and the position detecting unit determines, depending on whether the detecting unit has detected the first wall-like section, whether the shutter unit is located in the position to open the opening.

5. The write device according to claim 4, further comprising an informing unit that informs of an error if it is determined that the shutter unit is not located in the position to open the opening.

6. The write device according to claim 2, the control unit controlling the drive unit so as to rotate the rotator until a predetermined second delay time elapses after the detecting unit detects a predetermined second wall-like section included in the wall-like sections and so as to stop the rotation of the rotator when the second delay time elapses, and the position detecting unit determining, depending on whether the detecting unit has detected the second wall-like section, whether the shutter unit is located in a position to close the opening, the write device further comprising a correcting unit that corrects the second delay time if it is determined that the shutter unit is not located in the position to close the opening.

7. The write device according to claim 6, further comprising an input receiving unit that receives input of a second adjustment time from a user, wherein the correcting unit corrects the second delay time by using the second adjustment time, the control unit controls the drive unit so as to rotate the rotator until a corrected second delay time elapses after the detecting unit detects the second wall-like section and so as to stop the rotation of the rotator when the corrected second delay time elapses, and the position detecting unit determines, depending on whether the detecting unit has detected the second wall-like section, whether the shutter unit is located in the position to close the opening.

8. The write device according to claim 7, further comprising an informing unit that informs of an error if it is determined that the shutter unit is not located in the position to close the opening.

9. An image forming apparatus comprising:

a photoreceptor; and a write unit that exposes the photoreceptor, wherein the write unit includes an opening that is arranged on a casing that houses a light source that emits irradiation light to expose the photoreceptor, the opening allowing passage of the irradiation light;

a shutter unit that is movably mounted on the casing and is moved to open and close the opening;

a rotator that moves the shutter unit in accordance with rotation;

a drive unit that rotates the rotator;

a plurality of wall-like sections, each wall-like section having a different width and being arranged in a standing manner on a side intersecting with a rotary shaft of the rotator;

a detecting unit that detects each of the wall-like sections that are moved in accordance with the rotation of the rotator;

a measuring unit that measures a detection time period from when a wall-like section of the plurality of wall-like sections is detected until when the wall-like section is no longer detected;

a position detecting unit that determines which one of the wall-like sections is the detected wall-like section by using the measured detection time period and the width of each of the wall-like sections and detects a position of the shutter unit on the casing by using the determined wall-like section; and an exposure control unit that controls exposure in accordance with the position of the shutter unit.

10. The image forming apparatus according to claim 9, further comprising:

a cover that is openable and closable by a user; and an open/close detecting unit that detects an open state and a closed state of the cover, wherein the write unit further includes a control unit that controls the drive unit, the detecting unit, and the measuring unit, and if the open state of the cover is detected, the control unit controls the drive unit so as to rotate the rotator until a predetermined second delay time elapses after the detecting unit detects a predetermined second wall-like section included in the wall-like sections and so as to stop the rotation of the rotator when the second delay time elapses, thereby moving the shutter unit to a position to close the opening.

11. The image forming apparatus according to claim 10, wherein if the closed state of the cover is detected, the control unit controls the drive unit so as to start rotation of the rotator, the measuring unit so as to measure the detection time period, and the position detecting unit so as to detect a position of the shutter unit, the position detecting unit determines whether the shutter unit is located in a predetermined initial position by using the measured time period and the width of each of the wall-like sections, and the control unit controls the drive unit so as to rotate the rotator, the detecting unit so as to detect the wall-like sections, and the measuring unit so as to measure the detection time period until it is determined that the shutter unit is located in the initial position.

12. An open/close control method performed by a write device, the write device including an opening that is arranged on a casing that houses a light source that emits irradiation light to expose a photoreceptor, the opening allowing passage of the irradiation light;

a shutter unit that is movably mounted on the casing and is moved to open and close the opening;

a rotator that moves the shutter unit in accordance with rotation;

a drive unit that rotates the rotator;

a plurality of wall-like sections, each wall-like section having a different width and being arranged in a standing manner on a side intersecting with a rotary shaft of the rotator; and a detecting unit that detects each of the wall-like sections that are moved in accordance with the rotation of the rotator;

the open/close control method comprising:

measuring, by a measuring unit, a detection time period from when a wall-like section of the plurality of wall-like sections is detected until when the wall-like section is no longer detected;

determining which one of the wall-like sections is the detected wall-like section by using the measured detection time period and the width of each of the wall-like sections, thereby detecting a position of the shutter unit on the casing by using the determined wall-like section; and controlling exposure in accordance with the position of the shutter unit.

13. The open/close control method according to claim 12, the write device further including a control unit that controls the drive unit, the detecting unit, and the measuring unit, and the detecting including determining whether the shutter unit is located in a predetermined initial position by using the measured time period and the width of each of the wall-like sections, the open/close control method further comprising controlling the drive unit so as to rotate the rotator, the detecting unit so as to detect the wall-like sections, and the measuring unit so as to measure the detection time period until it is determined that the shutter unit is located in the initial position.

14. The open/close control method according to claim 13, the controlling including controlling the drive unit so as to rotate the rotator until a predetermined first delay time elapses after the detecting unit detects a predetermined first wall-like section included in the wall-like sections and so as to stop the rotation of the rotator when the first delay time elapses, and the detecting including determining, depending on whether the detecting unit has detected the first wall-like section, whether the shutter unit is located in a position to open the opening, the open/close control method further comprising correcting the first delay time if it is determined that the shutter unit is not located in the position to open the opening.

15. The open/close control method according to claim 14, further comprising receiving input of a first adjustment time from a user, wherein the correcting includes correcting the first delay time by using the first adjustment time, the controlling includes controlling the drive unit so as to rotate the rotator until a corrected first delay time elapses after the detecting unit detects the first wall-like section and so as to stop the rotation of the rotator when the corrected first delay time elapses, and the detecting includes determining, depending on whether the detecting unit has detected the first wall-like section, whether the shutter unit is located in the position to open the opening.

16. The open/close control method according to claim 15, further comprising informing of an error if it is determined that the shutter unit is not located in the position to open the opening.

17. The open/close control method according to claim 13, the controlling including controlling the drive unit so as to rotate the rotator until a predetermined second delay time elapses after the detecting unit detects a predetermined second wall-like section included in the wall-like sections and so as to stop the rotation of the rotator when the second delay time elapses, and the detecting including determining, depending on whether the detecting unit has detected the second wall-like section, whether the shutter unit is located in a position to close the opening, the open/close control method further comprising correcting the second delay time if it is determined that the shutter unit is not located in the position to close the opening.

18. The open/close control method according to claim 17, further comprising receiving input of a second adjustment time from a user, wherein the correcting includes correcting the second delay time by using the second adjustment time, the controlling includes controlling the drive unit so as to rotate the rotator until a corrected second delay time elapses after the detecting unit detects the second wall-like section and so as to stop the rotation of the rotator when the corrected second delay time elapses, and the detecting includes determining, depending on whether the detecting unit has detected the second wall-like section, whether the shutter unit is located in the position to close the opening.

19. The open/close control method according to claim 17, wherein the write device is mounted in an image forming apparatus that includes a cover that is openable and closable by a user, and the controlling includes, if an open state of the cover is detected, controlling the drive unit so as to rotate the rotator until the second delay time elapses after the detecting unit detects the second wall-like section and so as to stop the rotation of the rotator when the second delay time elapses, thereby moving the shutter unit to the position to close the opening.

20. The open/close control method according to claim 19, wherein the controlling includes, if a closed state of the cover is detected, controlling the drive unit so as to start rotation of the rotator, the measuring unit so as to measure the detection time period, and the position detecting unit so as to detect a position of the shutter unit, the detecting includes determining whether the shutter unit is located in a predetermined initial position by using the measured time period and the width of each of the wall-like sections, and the controlling includes controlling the drive unit so as to rotate the rotator, the detecting unit so as to detect the wall-like sections, and the measuring unit so as to measure the detection time period until it is determined that the shutter unit is located in the initial position.

* * * * *